United States Patent [19]

Ruud

[11] 3,997,776

[45] Dec. 14, 1976

[54] INDIRECT LIGHTING FIXTURE

[75] Inventor: Alan J. Ruud, West Allis, Wis.

[73] Assignee: Donald E. Goulet, Milwaukee, Wis. ; a part interest

[22] Filed: July 31, 1975

[21] Appl. No.: 600,642

[52] U.S. Cl. ..... 240/2 SL; 240/41.1; 240/81 BS

[51] Int. Cl.[2] ..... F21V 33/00; F21M 7/00; F21S 1/12

[58] Field of Search ..... 240/2 SL, 41.1, 41.15, 240/81 R, 81 BS

[56] References Cited

UNITED STATES PATENTS

| | | | |
|---|---|---|---|
| 2,102,224 | 12/1937 | Ruppel | 240/81 BS X |
| 2,279,770 | 4/1942 | Albright | 240/2 SL |
| 2,745,949 | 5/1956 | Berin | 240/81 R |
| 3,356,841 | 12/1967 | Horan | 240/81 R |
| 3,389,246 | 6/1968 | Shemitz | 240/81 R X |
| D118,161 | 12/1939 | Krueger | 240/81 R X |

*Primary Examiner*—George H. Miller, Jr.
*Attorney, Agent, or Firm*—James E. Nilles

[57] ABSTRACT

An indirect lighting fixture for illuminating a desk top with light reflected from a room ceiling and for close association with the desk side comprises a hollow base extending beneath the desk, a pair of laterally spaced apart hollow support legs connected to the outermost side corners of the base and extending upwardly alongside the desk, and a lamp compartment connected to the upper ends of the legs and extending over the desk top in cantilever fashion above eye level. The lamp compartment which is open at the top but provided with a lens contains a metal halide or high pressure sodium lamp and a reflector for aiming the lamp light directly onto the ceiling for reflection directly down onto the desk top. The base contains relatively heavy electrical ballast components for starting and operating the lamp which also serve to weight the base and stabilize the fixture. The electrical components in the base are connected to the lamp by conductors within one of the support legs and the base is provided with a line cord and on-off switch.

12 Claims, 12 Drawing Figures

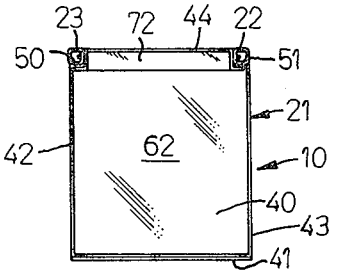
FIG. 6
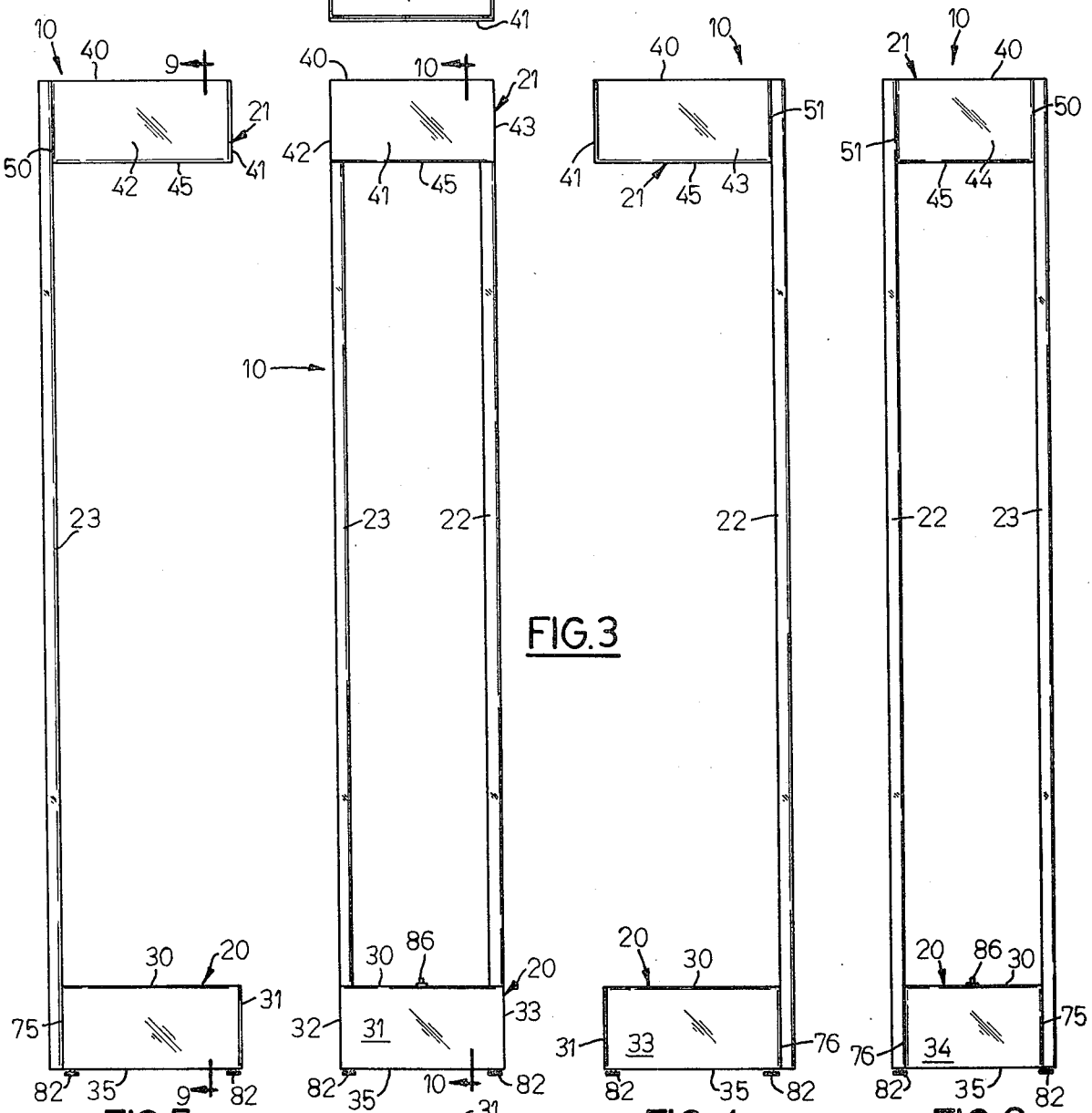
FIG. 3
FIG. 5
FIG. 4
FIG. 8
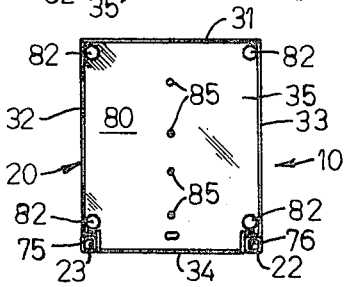
FIG. 7

INDIRECT LIGHTING FIXTURE

BACKGROUND OF THE INVENTION

1. Field of Use

This invention relates generally to indirect lighting fixtures and particularly to a free-standing portable fixture for use in close proximity with a furniture piece, such as a desk, to provide indirect illumination from a ceiling directly thereabove.

2. Description of the Prior Art

Indirect lighting fixtures take a variety of forms, some built into the floors, walls or ceilings or a room, others being portable units adapted to be free-standing on a floor or supporting base or table. Typically, the fixtures are aimed or elevated so that the light source is not directly visible to a person in the room. Some prior art indirect light fixtures take the form of a free-standing portable floor lamp having a relatively heavy cast iron base, a single support pole extending upwardly from the base, and an upwardly aimed lamp and reflector unit at or near the top of the pole. Such units are typically used for decorative purposes and employ an incandescent lamp bulb which is incapable of providing reflected light of sufficient intensity for working or reading. However, even in fixtures employing lamp of high intensity the design is often such that, if the fixture is placed alongside a furniture piece such as a desk, table or chair, the fixture occupies and wastes aisle or passage space there alongside and, furthermore, the reflected light does not fall in the optimism position on the furniture piece.

SUMMARY OF THE INVENTION

In accordance with the present invention there is provided a freestanding indirect lighting fixture for illuminating a furniture piece, such as a desk, table or chair with reflected light from above and adapted to fit in close compact relationship to the furniture piece so as to leave aisle or passage space there alongside. The fixture comprises a hollow base extendable underneath the desk and containing relatively heavy lamp starter components, a pair of upwardly extending laterally spaced apart hollow support legs for close disposition alongside the desk and connected at their lower ends to the outermost side of the base, and hollow open-topped lamp compartment containing a lamp and reflector for directing light upwardly for downward reflection from a ceiling onto the top of the furniture piece, said lamp compartment being connected at its outermost side to the upper ends of the support legs and extendable over the top of the desk above eye level in cantilever fashion. The lamp takes the form of a high intensity metal halide or high pressure sodium luminaire and the lamp starter components includes a ballast core and coil and ballast capacitor which are electrically connected to the lamp by wiring extending through one of the support legs. An on-off switch is mounted on the base and a flexible line cord connected through the switch to the starter components adapts the fixture for connection to an electric wall socket. The lamp compartment is provided with a glass cover lens at its open upper side.

An indirect lighting fixture in accordance with the invention offers several advantages over the prior art. For example, the fixture employs a high-intensity lamp, such as a metal halide or high pressure sodium luminaire, rather than a conventional lamp bulb, and is well-suited to provide reflected ceiling light suitable for reading or working to the top of the desk or other piece of furniture. Furthermore, the ballast components necessary for starting and operating the lamp are relatively heavy, and being located in the fixture base, give a great degree of mechanical stability to the lamp. The support legs, being located at or along the outermost sides of the base and the lamp compartment enable the base, lamp compartment and legs to fit flush with the side of the associated furniture piece. As a result, the fixture provides for maximum aisle or passage space and is not in the way. The top of the lamp compartment, being located above eye level, prevents direct lamp glare into the eyes of persons standing or sitting nearby. The fixture, being free-standing and portable, can be moved and repositioned as desired. Other objects and advantages of the invention will hereinafter appear.

BRIEF DESCRIPTION OF THE DRAWINGS

FIG. 3 is a front elevation view of the fixture shown in FIG. 2;

FIG. 4 is a right elevation view of the fixture shown in FIG. 3;

FIG. 5 is a left elevation view of the fixture shown in FIG. 3;

FIG. 6 is a top plan view of the fixture shown in FIG. 3;

FIG. 7 is a bottom plan view of the fixture shown in FIG. 3;

FIG. 8 is a rear elevation of the fixture shown in FIG. 3;

DESCRIPTION OF THE PREFERRED EMBODIMENT

Figure 2:
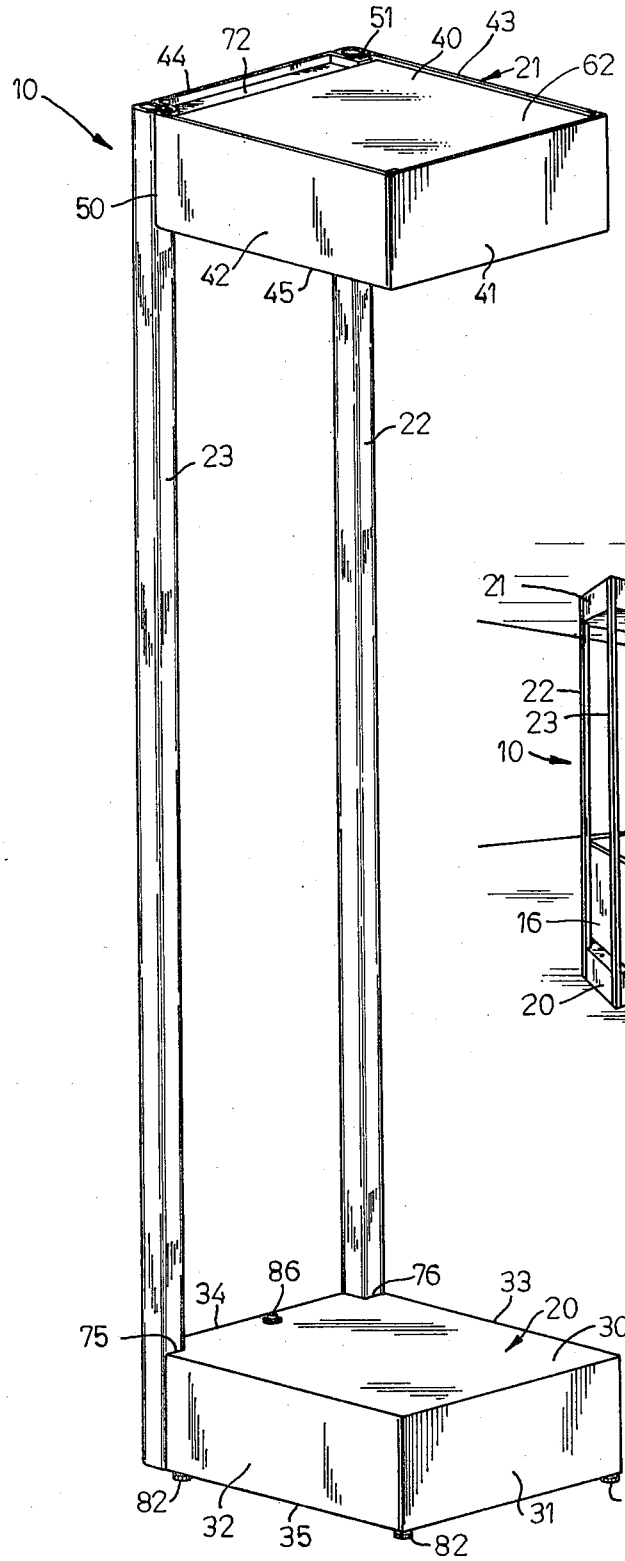
FIG. 2 is an enlarged isometric view of the front of the fixture shown in FIG. 1.
Figure 1:
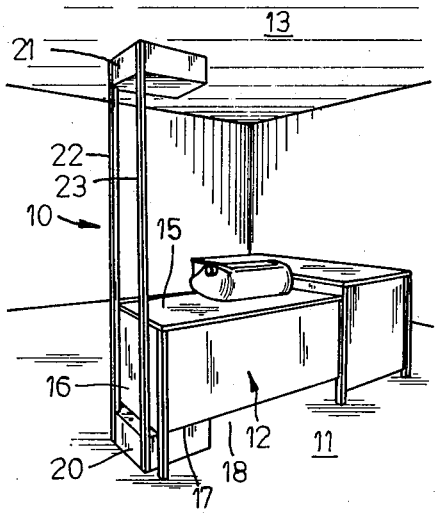
FIG. 1 is a perspective view of the rear of an indirect lighting fixture in accordance with the invention shown in association with a desk and light-reflecting ceiling.
Figure 10:
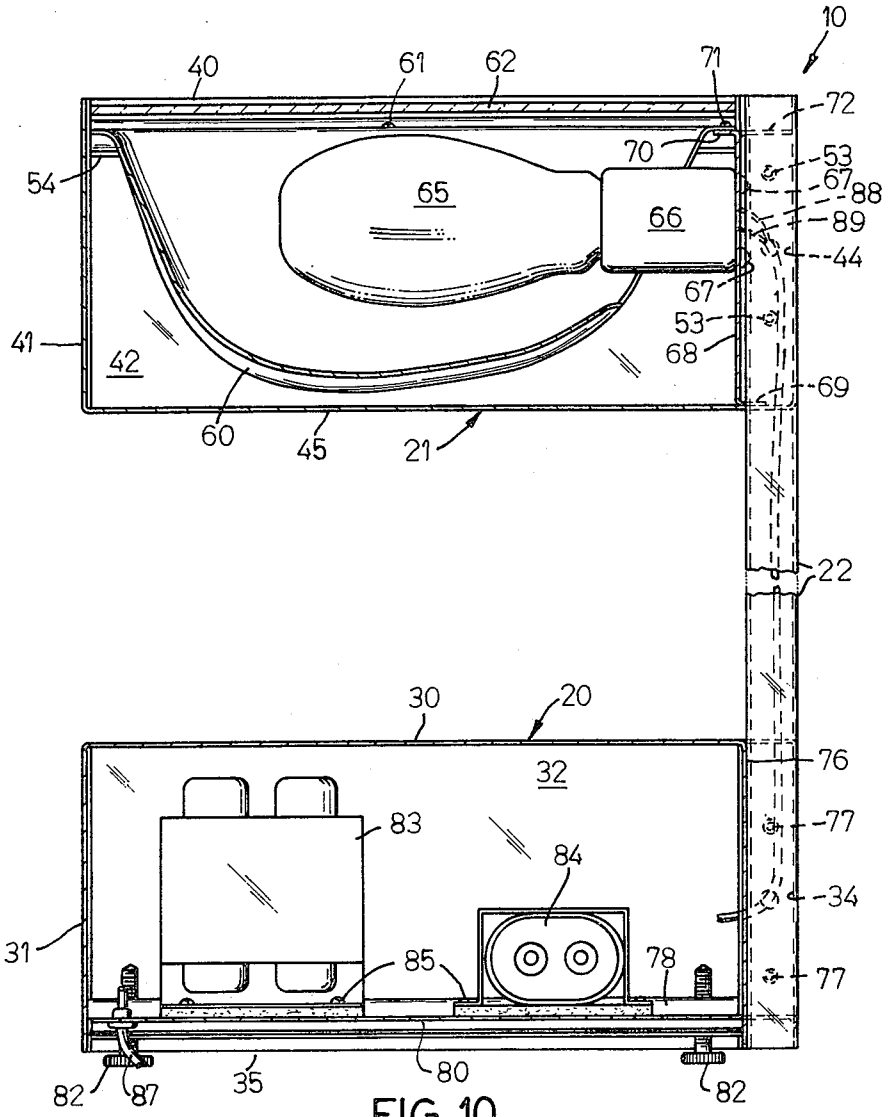
FIG. 10 is an enlarged cross-section view taken generally along line 10—10 of FIG. 3 with portions of the support legs deleted to conserve space.

Referring to FIG. 1, the numeral 10 designates an indirect lighting fixture in accordance with the invention shows free-standing on a room floor 11 in close association with a furniture piece, such as a desk 12, and positioned to effect reflection of light from the room ceiling 13 down onto the desk top.

Fixture 10 generally comprises a base 20 resting on floor 11 and extending into space 18 beneath the bottom 17 of desk 12, a lamp compartment 21 disposed at a height above eye level and extending in cantilever fashion over the top 15 of the desk, and a pair of laterally spaced apart vertically disposed hollow support legs 22 and 23 which are disposed closely adjacent the side or end 16 of the desk. The legs 22 and 23 are rigidly connected at their lower ends at or near the outer or rear side 34 of base 20 and at their upper ends at or near the outer or rear side 44 of lamp compartment 21. Fixture 10 projects a minimum distance into the aisle or passage adjacent the end 16 of desk 12.

For convenience in description and not by way of limitation base 20 is designated as having a top side 30, a front side 31, a left side 32, a right side 33, a rear side 34, and a bottom side 35. Lamp compartment 21 is designated as having a top side 40, a front side 41, a left side 42, a right side 43, a rear side 44, and a bottom side 45.

As FIGS. 2, 6, 9, 10 and 12 show, lamp compartment 21 is fabricated from a sheet metal stamping and includes a flat bottom 45 and upwardly bent sides 41, 42, 43 and 44 which are welded together at their corners. As FIG. 12 best shows, compartment 21 is constructed so as to provide rectangular recesses or notches 50 and 51 at the outermost corners where rear side 44 joins the left side 42 and the right side 43, respectively. The recesses 50 and 51 accommodate the upper ends of the support legs 22 and 23, respectively, which are rigidly secured to compartment 21 by screws 53. Compartment 21 is furnished on the upper inner surface of the sides 42 and 43 with elongated universal support brackets 54 and 55, respectively, of S-shaped cross-sectional configuration which are welded to the sides and afford support for a sheet metal reflector 60 which reflects light upwardly from lamp compartment 21. Reflector 60 is secured to the brackets 54 and 55 by screws 61. The brackets 54 and 55 also afford support for a lens 62 which may take the form of clear tempered glass and defines the top side 40 of lamp compartment 21. A lamp 65 in the form of a metal halide or high pressure sodium lamp is mounted in a lamp socket 66 and disposed between reflector 60 and lens 62. Lamp socket 66 is mechanically secured as by screws 67 to a stamped sheet metal socket plate 68 which is mounted in spaced apart inward relationship from rear side 44 by means of a lower flange 69 which is welded to the inner surface of bottom side 45 of compartment 21. Socket plate 68 has a pair of upper tabs 70 which afford additional support for reflector 60 which are secured thereto by screws 71. Socket plate 68 also has an upper flange 72 forming an enclosed wireway.

FIGS. 2, 7, 9, 10 and 11 show that base 20 takes the form of a ballast compartment fabricated from a sheet metal stamping and includes a flat top 30 and downwardly bent sides 31, 32, 33 and 34 which are welded together at their corners. As FIG. 11 best shows, base 20 is constructed so as to provide rectangular recesses or notches 75 and 76 at the outermost corners where rear side 34 joins the left side 32 and the right side 33, respectively. The recesses 75 and 76 accommodate the lower ends of the support legs 22 and 23, respectively, which are rigidly secured to base 20 by screws 77. Base 20 is furnished on the lower inner surfaces of the sides 32 and 33 with elongated universal support brackets 78 and 79, respectively, of S-shaped cross-sectional configuration which are welded to the sides and afford support for a sheet metal base plate 80. The brackets 78 and 79 also afford support for four nuts 81 which are welded thereto and through which threaded levelling screws 82 are screwed. Each screw may be independently adjusted to effect levelling of fixture 10. Base plate 80 affords support for electrical components such as a core and coil ballast unit 83 and a ballast capacitor 84 which are secured thereto by suitable means including screws 85. The electrical components is base 20 are relatively heavier than components in lamp compartment 21 and serve to stabilize, weigh down and balance the fixture 10. Since lamp compartment 21 is cantilevered from the support legs 22 and 23, it is preferred for balancing purposes to locate the relatively heavier unit 83 toward the side 31 of compartment 20 and away from the legs 22 and 23.

Figure 9:
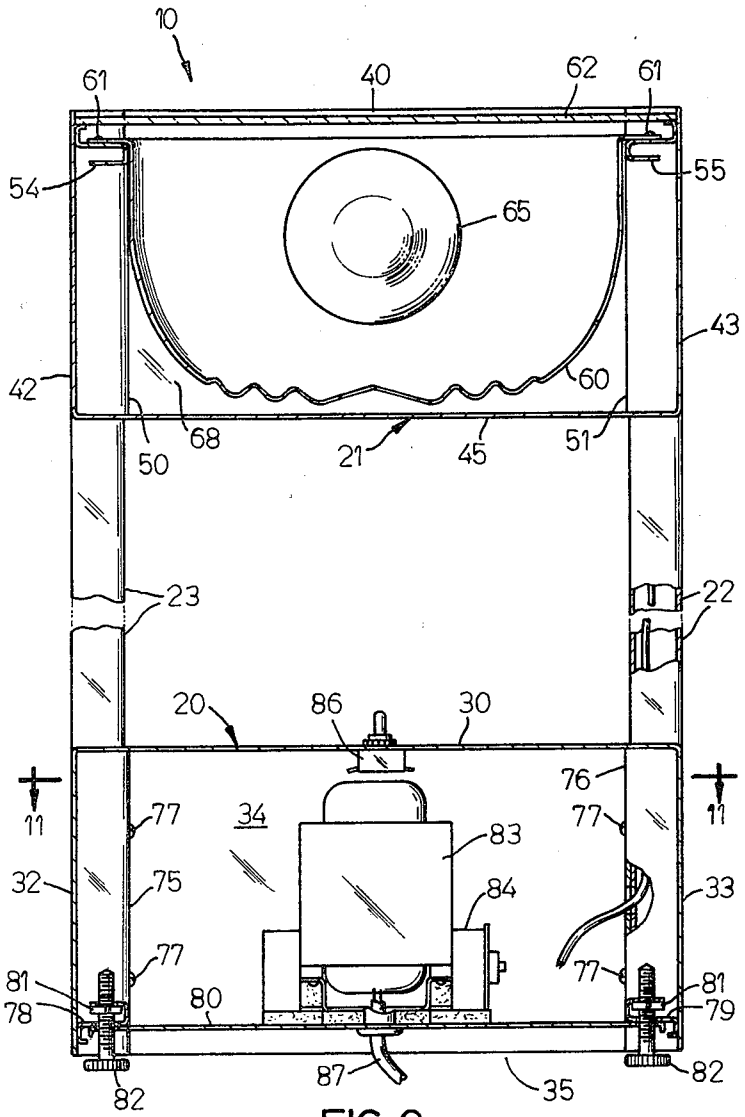
FIG. 9 is an enlarged cross-section view taken on line 9—9 of FIG. 5 with portions of the support legs deleted to conserve space.
Figure 11:
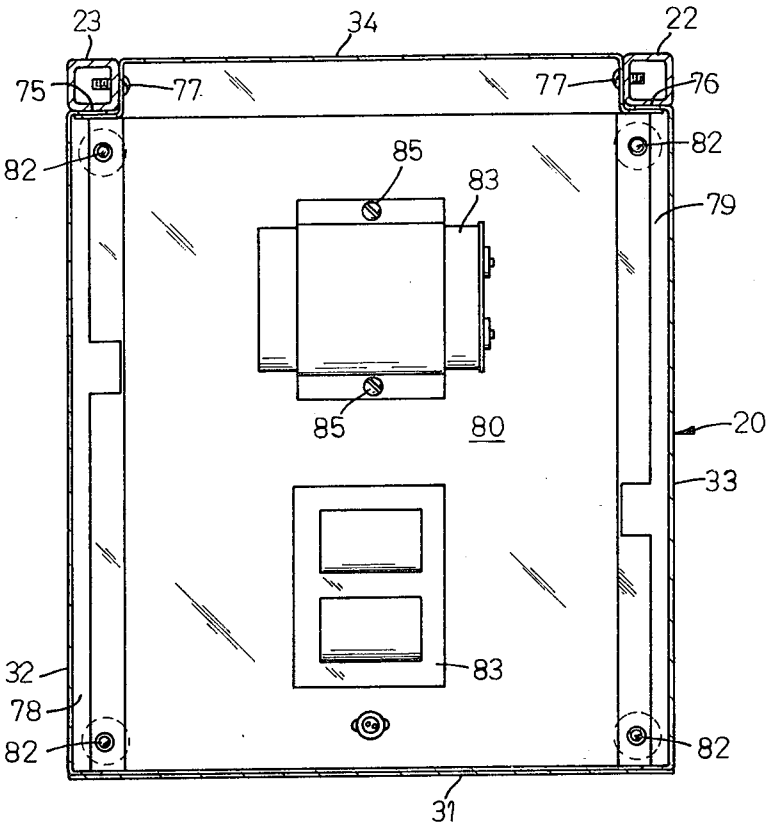
FIG. 11 is a cross-section view of the fixture base taken on line 11—11 of FIG. 9 showing interior details.
Figure 12:
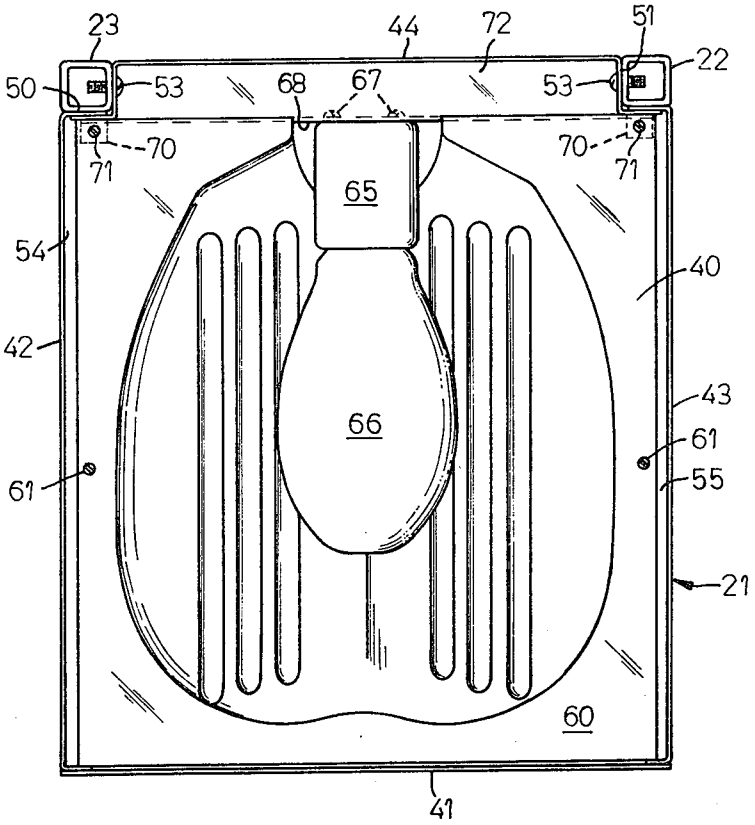
FIG. 12 is a top plan view of the lamp compartment with the cover lens removed to show interior details.

As FIG. 9 shows, base 21 is provided with a manually operable on-off switch 86 on top side 30 between the legs 22 and 23 for easy accessibility when unit 10 is positioned near desk 12 as shown in FIG. 1. If switch 86 is push-push type it could be foot-operated.

A flexible line cord 87 extends into base 21 through bottom side 35 and adapts fixture 10 for electrical connection to a conventional wall plug. A pair of electrical conductors 88 and 89 are connected to lamp socket 66 and extend from lamp compartment 21 downwardly through hollow leg 22 into base 20 for suitable electrical connection to the line cord 87, switch 86 and units 83 and 84. The walls of base 20 and compartment 21 and the leg 22 are, of course, provided with suitable registering holes for accommodating the passage of the conductors 88 and 89 and line cord 87.

I claim:

1. An indirect lighting fixture comprising:

a hollow base having lamp operating electrical components therein;

a lamp compartment in registry with and disposed above said base and having a lamp and reflector means therein for directing light upwardly, said lamp compartment being open to accommodate light transmission on its upper side and closed against light transmission on its lower side;

said base and said components therein having a combined weight greater than the combined weight of said lamp compartment and said lamp and reflector means therein;

at least one hollow upwardly extending support leg connected near a side of said base and connected near a corresponding side of said lamp compartment for holding said lamp compartment above eye level;

electrical conductor means electrically connected between said components and said lamp and extending through said leg; and a line cord electrically connected to said components in said base.

2. An indirect lighting fixture according to claim 1 wherein said electrical components include an on-off switch.

3. An indirect lighting fixture according to claim 2 including a pair of laterally spaced apart support legs.

4. An indirect lighting fixture according to claim 3 wherein said switch is located between said pair of support legs near said side of said base.

5. An indirect lighting fixture comprising:

a hollow base having a flat outer side;

a lamp compartment having a flat outer side in registry with and disposed above said base, said lamp compartment being open to accommodate light transmission on its upper side and closed against light transmission on its lower side;

a lamp and reflector means in said lamp compartment for directing light upwardly;

at least one hollow upwardly extending support leg connected near said flat side of said base and connected near the corresponding flat side of said lamp compartment for holding said lamp compartment above said base at a distance which exceeds average human eye level;

electrical components in said base for operating said lamp, said base and said components therein having a combined weight greater than the combined weight of said lamp compartment and said lamp and reflector means therein;

electrical conductor means electrically connected between said components and said lamp and extending through said leg; and a line cord electrically connected to said components in said base.

6. An indirect lighting fixture according to claim 5 wherein said electrical components include an on-off switch.

7. An indirect lighting fixture according to claim 6 including a pair of laterally spaced apart support legs.

8. An indirect lighting fixture according to claim 7 wherein said switch is located between said pair of support legs near said flat side of said base.

9. In combination:

a furniture piece having a top, a side and a space therebeneath accessible from said side;

and a free-standing indirect lighting fixture associated with said furniture piece;

said fixture comprising a base extending into said space from said side;

a lamp compartment disposed over the top of said furniture piece and in registry with said base, said lamp compartment being open to accommodate light transmission on its upper side and closed against light transmission on its lower side;

a lamp and reflector means within said compartment for directing light upwardly for downward reflection from a ceiling onto the top of said furniture piece;

at least one hollow supporting leg connected between a side of said base nearest said side of said furniture piece and a corresponding side of said lamp compartment for holding said lamp compartment elevated at a distance in excess of average human eye level;

electrical components in said base for operating said lamp;

and electrical conductor means electrically connected between said components and said lamp and extending through said supporting leg.

10. A combination according to claim 9 wherein the combined weight of said base and said electrical components therein exceeds the combined weight of said lamp compartment and said lamp reflector means therein.

11. A combination according to claim 10 wherein said fixture comprises a pair of laterally spaced apart supporting legs.

12. A combination according to claim 11 wherein said electrical components in said base includes an on-off switch.

* * * * *